US009531132B2

(12) United States Patent
Iwamoto

(10) Patent No.: US 9,531,132 B2
(45) Date of Patent: Dec. 27, 2016

(54) CONNECTOR HAVING SHIELDING STRUCTURE WITH SHIELD SHELL AND SHIELD COVER

(71) Applicant: Hosiden Corporation, Yao-shi, Osaka (JP)

(72) Inventor: Yuta Iwamoto, Yao (JP)

(73) Assignee: HOSIDEN CORPORATION, Yao-Shi (JP)

( * ) Notice: Subject to any disclaimer, the term of this patent is extended or adjusted under 35 U.S.C. 154(b) by 0 days.

(21) Appl. No.: 14/863,824

(22) Filed: Sep. 24, 2015

(65) Prior Publication Data

US 2016/0093984 A1 Mar. 31, 2016

(30) Foreign Application Priority Data

Sep. 30, 2014 (JP) ..... 2014-199730

(51) Int. Cl.

| | |
|---|---|
| ***H01R 9/03*** | (2006.01) |
| ***H01R 13/6581*** | (2011.01) |
| ***H01R 13/6593*** | (2011.01) |
| *H01R 4/18* | (2006.01) |
| *H01R 13/506* | (2006.01) |

(52) U.S. Cl.

CPC ..... *H01R 13/6581* (2013.01); *H01R 9/035* (2013.01); *H01R 13/6593* (2013.01); *H01R 4/184* (2013.01); *H01R 13/506* (2013.01)

(58) Field of Classification Search

CPC .. H01R 13/6581; H01R 13/6593; H01R 9/035
USPC ..... 439/607.55
See application file for complete search history.

(56) References Cited

U.S. PATENT DOCUMENTS

| | | | | |
|---|---|---|---|---|
| 5,145,409 | A * | 9/1992 | Sato | H01R 9/0518 439/585 |
| 5,232,380 | A * | 8/1993 | Inoue | H01R 13/6593 439/585 |
| 5,667,404 | A * | 9/1997 | Kato | H01R 24/40 439/578 |
| 5,725,395 | A | 3/1998 | Lee | |
| 6,217,381 | B1 | 4/2001 | Kameyama | |

(Continued)

FOREIGN PATENT DOCUMENTS

| | | |
|---|---|---|
| EP | 1003249 | 5/2000 |
| EP | 2178177 | 4/2010 |
| JP | 5064983 | 8/2012 |

OTHER PUBLICATIONS

European Search Report dated Feb. 10, 2016, 8 pages.

*Primary Examiner* — Tulsidas C Patel
*Assistant Examiner* — Peter G Leigh
(74) *Attorney, Agent, or Firm* — Rankin, Hill & Clark LLP

(57) ABSTRACT

A connector has a shielding structure configured by: a shield shell, which has in the front end a tubular shielding portion that surrounds, accommodates, and fixes a resin housing, in the rear end, a barrel portion that crimps and fixes a sheath of a cable, and, between the shielding portion and the barrel portion, an opening portion that is upwardly opened; and a shield cover, which is attached from the upper side to the opening portion of the shield shell. Stoppers that limit rearward movement of the resin housing by causing a plate surface to be butted against a rear end surface of the resin housing that is fixed at the normal position in the shielding portion are disposed in the shield cover.

2 Claims, 6 Drawing Sheets

(56) References Cited

U.S. PATENT DOCUMENTS

| | | | | |
|---|---|---|---|---|
| 6,270,377 | B1 * | 8/2001 | Miyazaki | H01R 9/0527 439/607.41 |
| 7,011,553 | B2 * | 3/2006 | Hayashi | H01R 13/4367 439/460 |
| 8,167,653 | B2 * | 5/2012 | Hasegawa | H01R 13/74 439/607.41 |
| 8,187,036 | B2 * | 5/2012 | Fujiwara | H01R 9/0518 439/578 |
| 8,303,343 | B2 * | 11/2012 | Nagata | H01R 13/6582 439/607.54 |
| 8,777,665 | B2 * | 7/2014 | Il | H01R 13/6593 439/607.27 |
| 8,870,596 | B2 * | 10/2014 | Ii | H01R 13/6581 439/607.41 |
| 2010/0136832 | A1 * | 6/2010 | Kawaguchi | H01R 9/035 439/607.03 |
| 2011/0081803 | A1 * | 4/2011 | Kawaguchi | H01R 9/035 439/607.5 |
| 2011/0143594 | A1 * | 6/2011 | Nagata | H01R 13/6461 439/607.54 |
| 2013/0023155 | A1 * | 1/2013 | Ii | H01R 13/6593 439/607.27 |
| 2013/0052866 | A1 * | 2/2013 | Ii | H01R 13/6581 439/607.41 |
| 2016/0093983 | A1 * | 3/2016 | Tanaka | H01R 13/6581 439/607.55 |
| 2016/0093984 | A1 * | 3/2016 | Iwamoto | H01R 13/6581 439/607.55 |

* cited by examiner

CONNECTOR HAVING SHIELDING STRUCTURE WITH SHIELD SHELL AND SHIELD COVER

TECHNICAL FIELD

The present invention relates to a connector which is to be attached to an end of a cable.

BACKGROUND ART

Patent Literature 1 relates to a connector which is to be attached to an end of a cable, and discloses several connectors each having a shielding structure (shield configured by assembly components) configured by a shield shell and a shield cover. The shield shell includes: metal terminals each having, in the front end, a contacting portion which is to be electrically connected to a fitting counter connector, and, in the rear end, a connecting portion which is to be connected to a core wire of the cable; and a resin housing which holds the metal terminals, and is formed by sheet-metal working. The shield shell has: in the front end, a tubular shielding portion which surrounds, accommodates, and fixes the resin housing; in the rear end, a barrel portion which crimps and fixes the sheath of the cable; and, between the shielding portion and the barrel portion, an opening portion which is upwardly opened. The shield cover is formed separately from the shield shell by sheet-metal working, and attached from the upper side to the opening portion of the shield shell. The shield cover is configured by: a cover piece portion which, when the shield cover is attached from the upper side to the opening portion of the shield shell, covers the upper opening surface of the opening portion; and a pair of attaching piece portions which are downwardly extended from the both side parts of the cover piece portion, to overlap with the inner sides of the side surfaces of the opening portion, respectively. Patent Literature 1 discloses a connector in which, when the resin housing is to be inserted into the shielding portion of the shield shell, the insertion is performed from the front side of the shielding portion, that in which the insertion is performed from the rear side of the shielding portion, and the like.

In such a connector, usually, the shield shell is configured so that metal lances which are elastic cut and raised plate portions are disposed on the side surfaces of the opening portion, respectively, and, when the shield cover is attached from the upper side to the opening portion, the metal lances are engaged with engaging holes formed in the pair of attaching piece portions of the shield cover, respectively, thereby fixing the shield cover.

Alternatively, the shield shell is configured so that a stopper which is a non-elastic cut and raised plate portion, and a metal lance which is an elastic cut and raised plate portion are disposed in the shielding portion, and, when the resin housing is completely inserted, the stopper is butted against a step surface that is formed on the outer wall of the resin housing, and that is directed in the insertion direction, and the metal lance is engaged with a step surface that is formed on the outer wall of the resin housing, and that is directed in the pull-out direction, whereby the resin housing is fixed at the normal position in the shielding portion.

In the connector in which the resin housing is inserted from the front side of the shielding portion, rearward movement of the resin housing is limited by the stopper disposed in the shielding portion, and, in that in which the resin housing is inserted from the rear side of the shielding portion, rearward movement of the resin housing is limited by the metal lance disposed in the shielding portion.

PRIOR ART LITERATURE

Patent Literature

Patent Literature 1: Japanese Patent No. 5064983

SUMMARY OF THE INVENTION

Problems to be Solved by the Invention

Usually, a stopper disposed in a shielding portion of a shield shell has a configuration where an end surface of a cut and raised plate portion is butted against a step surface which is formed on the outer wall of a resin housing, and which is directed in the insertion direction, or that where a plate surface of a cut and raised plate portion is butted against a step surface which is formed on the outer wall of a resin housing, and which is directed in the insertion direction. On the other hand, a metal lance disposed on a shielding portion must be configured so that an end surface of a cut and raised plate portion is butted against a step surface which is formed on the outer wall of a resin housing, and which is directed in the pull-out direction.

In the above-described conventional connector, when the cable is pulled with a strong force, the force is applied in the sequence of the core wires of the cable→the metal terminals→the resin housing. In the case of the stopper and metal lance which cause the end surface of the cut and raised plate portion to be butted against a rearwardly directed step surface formed on the outer wall of the resin housing, therefore, the cut and raised plate portion bites into the step surface of the resin housing. A trace of the bite causes the resin housing to rattle in the anteroposterior direction. Sometimes, the step surface of the resin housing is shaved, and there is a possibility that the resin housing may slip off from the shielding portion.

In the case of the stopper which causes the plate surface of the cut and raised plate portion to be butted against a rearwardly directed step surface formed on the outer wall of the resin housing, by contrast, it is considered that the cut and raised plate portion does not shave the step surface of the resin housing, and also does not bite into the step surface of the resin housing. However, this stopper is used in a connector in which the resin housing is to be inserted from the front side into the shielding portion, and is not used in a connector in which the resin housing is to be inserted from the rear side into the shielding portion. In the latter connector, therefore, a countermeasure against slipping off of the resin housing in the cable pulling (rearward) direction must be taken in addition to the metal lance disposed in the shielding portion.

Consequently, it may be contemplated that the stopper for the former connector (the stopper which causes the plate surface of the cut and raised plate portion to be butted against a rearwardly directed step surface formed on the outer wall of the resin housing) is added to the latter connector. When the resin housing is to be inserted from the rear side into the shielding portion, however, the stopper projects into the insertion path for the resin housing to interfere with the resin housing. After the resin housing is completely inserted, therefore, the stopper must be bent and raised from the shielding portion, and then butted against the rearwardly directed step surface formed on the outer wall of the resin housing. Consequently, the connector has a problem in that steps of assembling the connector are increased.

The invention has been conducted in view of the above-discussed circumstances. It is an object of the invention to provide a connector in which a countermeasure against slipping off of a resin housing in a cable pulling direction is newly taken.

Means for Solving the Problems

As means for attaining the object, the first invention provides a connector 10 including: metal terminals 20 each having, in the front end, a contacting portion 21 that is to be electrically connected to a fitting counter connector, and, in the rear end, a connecting portion 22 that is to be connected to a core wire 2 of a cable 1; and a resin housing 30 that holds the metal terminals, the connector having a shielding structure configured by: a shield shell 40 which is formed by sheet-metal working, and which has in the front end a tubular shielding portion 41 that surrounds, accommodates, and fixes the resin housing, in the rear end, a barrel portion 42 that crimps and fixes a sheath 4 of the cable, and, between the shielding portion and the barrel portion, an opening portion 43 that is upwardly opened; and a shield cover 50 which is formed separately from the shield shell by sheet-metal working, and which is attached from the upper side to the opening portion of the shield shell, wherein stoppers 56 are disposed in the shield cover, and the stoppers limit rearward movement of the resin housing by causing a plate surface 55 to be butted against a rearwardly directed step surface which is formed on a rear end surface 33 or outer wall of the resin housing that is fixed at the normal position in the shielding portion.

The second invention provides a connector wherein, in the connector of the first invention, the shield cover has: a cover piece portion 51 which, when the shield cover is attached from the upper side to the opening portion of the shield shell, covers the upper opening surface of the opening portion; and a pair of attaching piece portions 52 which are downwardly extended from the both side parts of the cover piece portion, to overlap with the outer sides of the side surfaces of the opening portion, respectively, the stoppers are disposed in the pair of attaching piece portions, each of the pair of stoppers 56, 56 is configured by a metal piece which is forwardly projected from the corresponding attaching piece portion, and which is bent into an L-like shape to direct a tip end to the inner side, a pair of slits 48, 48 are disposed in both side parts of the shielding portion, tip end portions of the pair of stoppers which are inwardly directed being fitted from the upper side into the slits when the shield cover is attached from the upper side to the opening portion of the shield shell, respectively, thereby causing plate surfaces of the pair of stoppers to be butted against the rearwardly directed step surface which is formed on the rear end surface or outer wall of the resin housing that is accommodated at the normal position in the shielding portion, and, when the shield cover is to be attached from the upper side to the opening portion of the shield shell, the pair of stoppers function as a guide to the normal attachment position of the shield cover.

Effects of the Invention

According to the first invention, the stoppers which limit rearward movement of the resin housing by causing a plate surface to be butted against a rearwardly directed step surface which is formed on a rear end surface or outer wall of the resin housing that is fixed at the normal position in the shielding portion are disposed in the shield cover. Therefore, a countermeasure against slipping off of the resin housing in the cable pulling direction can be taken similarly in both a connector in which the resin housing is to be inserted from the front side into the shielding portion, and that in which the resin housing is to be inserted from the rear side of the shielding portion. In a connector in which the resin housing is to be inserted from the rear side of the shielding portion, particularly, a countermeasure against slipping off of the resin housing in the cable pulling direction can be taken without increasing steps of assembling the connector.

In the case where a configuration where a stopper which is a non-elastic cut and raised plate portion, and a metal lance which is an elastic cut and raised plate portion are disposed in the shielding portion, and, when the resin housing is completely inserted, the stopper is butted against the step surface that is formed on the outer wall of the resin housing, and that is directed in the insertion direction, and the metal lance is engaged with a step surface that is formed on the outer wall of the resin housing, and that is directed in the pull-out direction, thereby fixing the resin housing at the normal position in the shielding portion is employed as the shield shell, even when the stopper or metal lance which limits the rearward movement of the resin housing, and which is disposed in the shielding portion causes the end surface of the cut and raised plate portion to be butted against the rearwardly directed step surface that is formed on the outer wall of the resin housing, the stopper or the metal lance can function as a stopper for the resin housing in the cable pulling direction, without shaving the step surface of respectively, and without biting into the step surface of the resin housing. Therefore, double countermeasures against slipping off of the resin housing in the cable pulling direction can be taken.

According to the second invention, when the shield cover is to be attached from the upper side to the opening portion of the shield shell, the pair of stoppers disposed in the shield cover function as a guide to the normal attachment position of the shield cover. Therefore, the connector can be easily assembled as compared to the conventional connector.

DESCRIPTION OF PREFERRED EMBODIMENTS

Hereinafter, a connector which is an embodiment of the invention will be described with reference to the drawings. The connector 10 is a male connector which is attached to an end of a cable 1, and which uses a female connector as a fitting counter connector. In the specification, description will be made assuming that the side of the connector 10 which is to be fitted (connected) to the fitting counter connector is "front," and that which is to be connected to the cable 1 is "rear."

Figure 4:
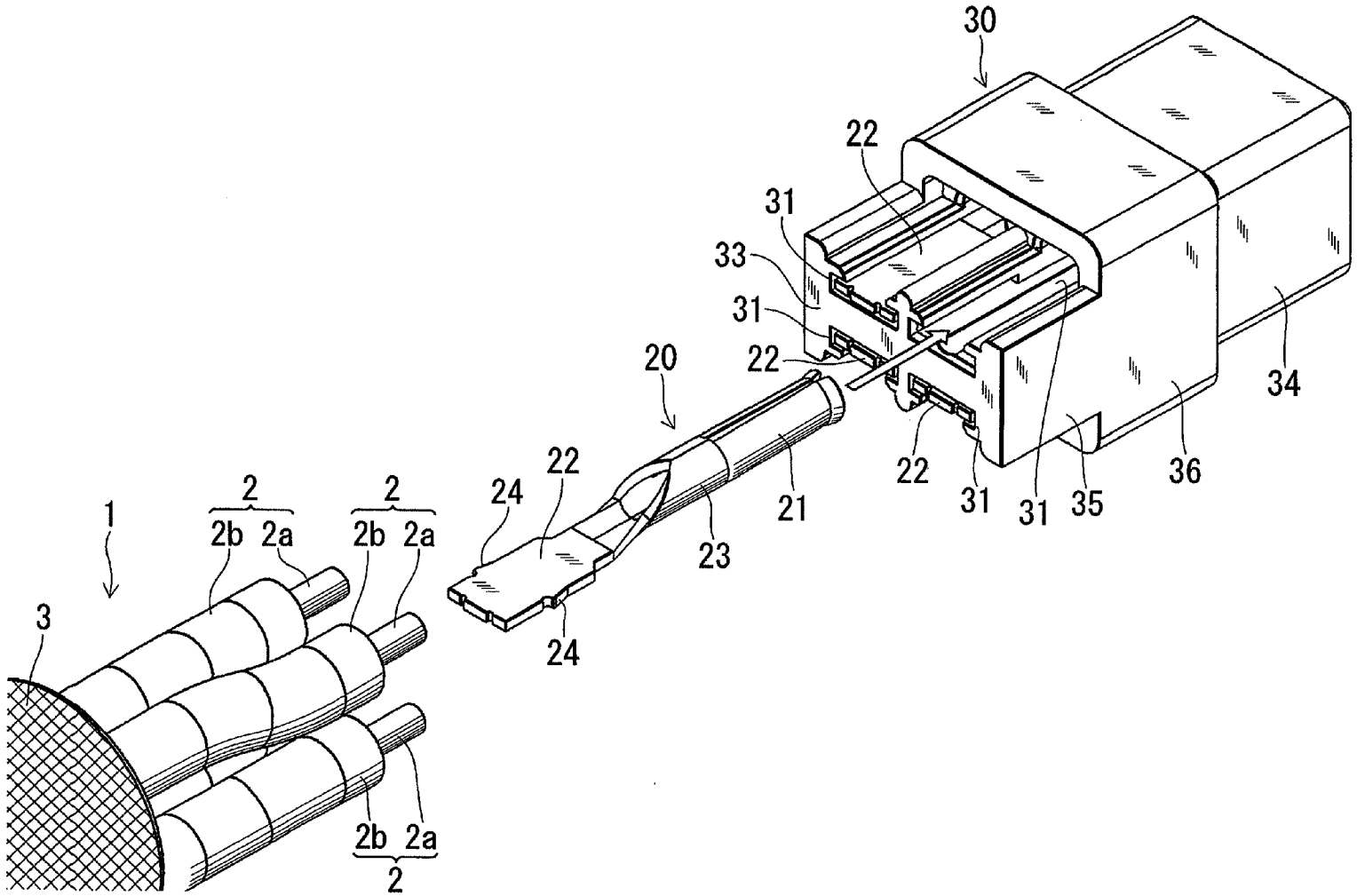
FIG. 4 is a perspective view showing a cable, metal terminal, and resin housing of the connector in a disassembled state.
Figure 5:
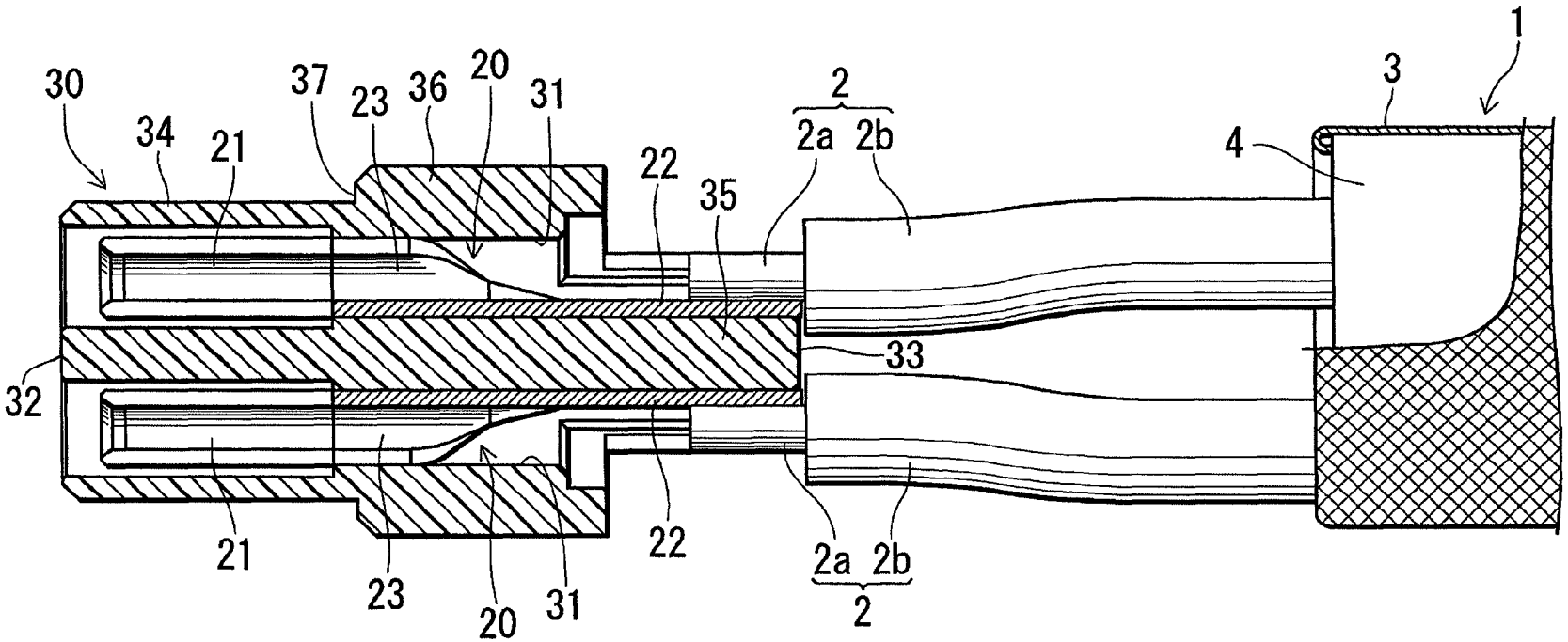
FIG. 5 is a side sectional view showing the cable, metal terminals, and resin housing of the connector in an assembled state.

As shown in FIGS. 4 and 5, the cable 1 is configured by core wires 2 of four cores and two pairs (differential pairs), a shield 3 which covers the peripheries of the core wires 2, and a sheath (outer jacket) 4 which covers the periphery of the shield 3. Each of the core wires 2 is configured by a covered electric wire in which a conductor 2*a* is covered by an insulator 2*b*. The shield 3 is configured by at least one of a conductive braided shield and a foil shield. In the end of the cable 1 to which the connector 10 is to be attached, the shield 3 which is exposed by peeling off the sheath 4 is folded back to the outside of the sheath 4, and ends of the insulators 2*b* of the core wires 2 which are exposed from the sheath 4 are further peeled off to expose the conductors 2*a* of the core wires 2.

As shown in FIGS. 1 to 6, the connector 10 is configured by metal terminals 20, a resin housing 30, a shield shell 40, a shield cover 50, and a resin outer housing which is not shown. The metal terminals 20, the resin housing (resin inner housing) 30, the shield shell 40, and the shield cover 50 constitute the connector body.

Each of the metal terminals 20 is formed by performing sheet-metal working on a conductive metal plate material, and, as shown in FIGS. 4 and 5, has, in the front end, a contacting portion 21 which is to be connected to a metal terminal of the fitting counter connector, and, in the rear end, a connecting portion 22 which is to be connected to the core wire 2 of the cable 1, and further has a basal portion 23 between the contacting portion 21 and the connecting portion 22. In accordance with the number of the core wires 2 of the cable 1, four metal terminals 20 are disposed. The contacting portion 21 is forwardly extended from the basal portion 23, and forms a two-slit cylindrical elastic socket. The connecting portion 22 is rearwardly extended from the basal portion 23, and forms a rectangular soldering portion to which the conductor 2*a* of the core wire 2 is to be mechanically and electrically connected by soldering. In the connecting portion 22, projection claws 24 are formed on the both side surfaces, respectively. The portion functions also as a portion for fixing the metal terminal 20 to the resin housing 30.

Figure 1:
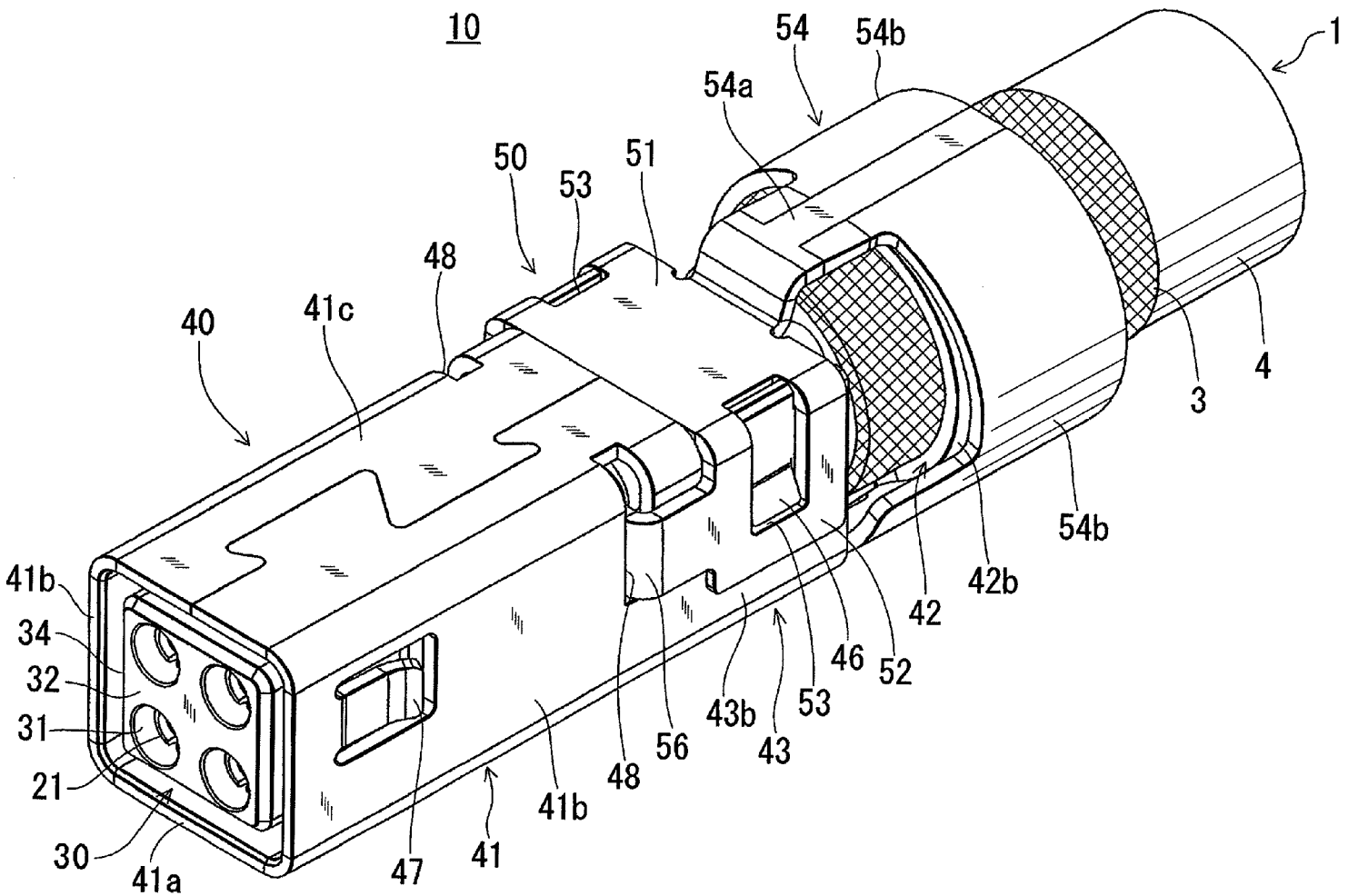
FIG. 1 is a perspective view of a connector of an embodiment of the invention.

The resin housing 30 holds the conductive metal terminals 20, is formed by performing molding by using an insulative synthetic resin material, and, as shown in FIGS. 1, 4, and 5, has terminal accommodating chambers 31 into which the metal terminals are inserted. The resin housing has a substantially rectangular parallelepiped outer shape as a whole. The terminal accommodating chambers 31 are formed in the whole length of the resin housing 30. In each of the terminal accommodating chambers 31, the front end is opened in the front end surface 32 of the resin housing 30 to be formed as an insertion port for a metal terminal of the fitting counter connector, and the rear end is opened in the rear end surface 33 of the resin housing 30 to be formed as an insertion port for the metal terminal 20. The resin housing 30 has, in the front end, a fitting portion 34 with respect to the fitting counter connector, and, in the rear end, a connecting portion 35 for the core wires 2 of the cable 1. A fixing portion 36 for the shield shell 40 is disposed between the fitting portion 34 and the connecting portion 35. The fixing portion 36 has a rectangular sectional shape, and the fitting portion 34 has a rectangular sectional shape which is slightly smaller than the section shape of the fixing portion 36, and is forwardly projected from the front end of the fixing portion 36. A forwardly directed step surface 37 is formed between the outer wall of the fixing portion 36, and that of the fitting portion 34. The connecting portion 35 has a rectangular sectional shape which is thinner than the sectional shape of the fixing portion 36, and is rearwardly projected from the rear end of the fixing portion 36. In the fitting portion 34 and the fixing portion 36, the terminal accommodating chambers 31 are formed into a cylindrical shape, and, in the connecting portion 35, formed into a groove shape which is opened toward the outside. In accordance with the number of the metal terminals 20, four terminal accommodating chambers 31 are disposed. Two terminal accommodating chambers are laterally arranged in each of the upper and lower portions of the resin housing 30. The terminal accommodating chambers 31 of the upper pair are upwardly opened in the connecting portion 35, and the terminal accommodating chambers 31 of the lower pair are downwardly opened in the connecting portion 35. When the four metal terminals 20 are inserted one by one into the four terminal accommodating chambers 31 from the rear side of the resin housing 30, the resin housing 30 holds the four metal terminals 20 in a mutually insulated condition in a state where the front ends of the contacting portions 21 of the four metal terminals 20 are opened toward the front end openings (insertion ports for the metal terminals of the fitting counter connector) of the terminal accommodating chambers 31, respectively, and the connecting portions 22 of the four metal terminals 20 are exposed in the connecting portion 35 of the resin housing 30 toward the outside. In the metal terminals 20 of the upper pair, the upper surfaces of the connecting portions 22 are exposed toward the upper side in the connecting portion 35 of the resin housing 30, and, in the metal terminals 20 of the lower pair, the lower surfaces of the connecting portions 22 are exposed toward the lower side in the connecting portion 35 of the resin housing 30.

The resin housing 30 holds the four metal terminals 20 in a mutually insulated condition as shown in FIG. 5, and is then mechanically connected to the cable 1. Namely, the conductors 2*a* of the one pair of core wires 2 which are exposed in the end of the cable 1 are soldered respectively to the upper surfaces of the connecting portions 22 of the metal terminals 20 of the upper pair which are exposed toward the upper side in the connecting portion 35 of the resin housing 30, and the conductors 2*a* of the other pair of core wires 2 which are exposed in the end of the cable 1 are soldered respectively to the lower surfaces of the connecting portions 22 of the metal terminals 20 of the lower pair which are exposed toward the lower side in the connecting portion 35 of the resin housing 30.

Figure 2:
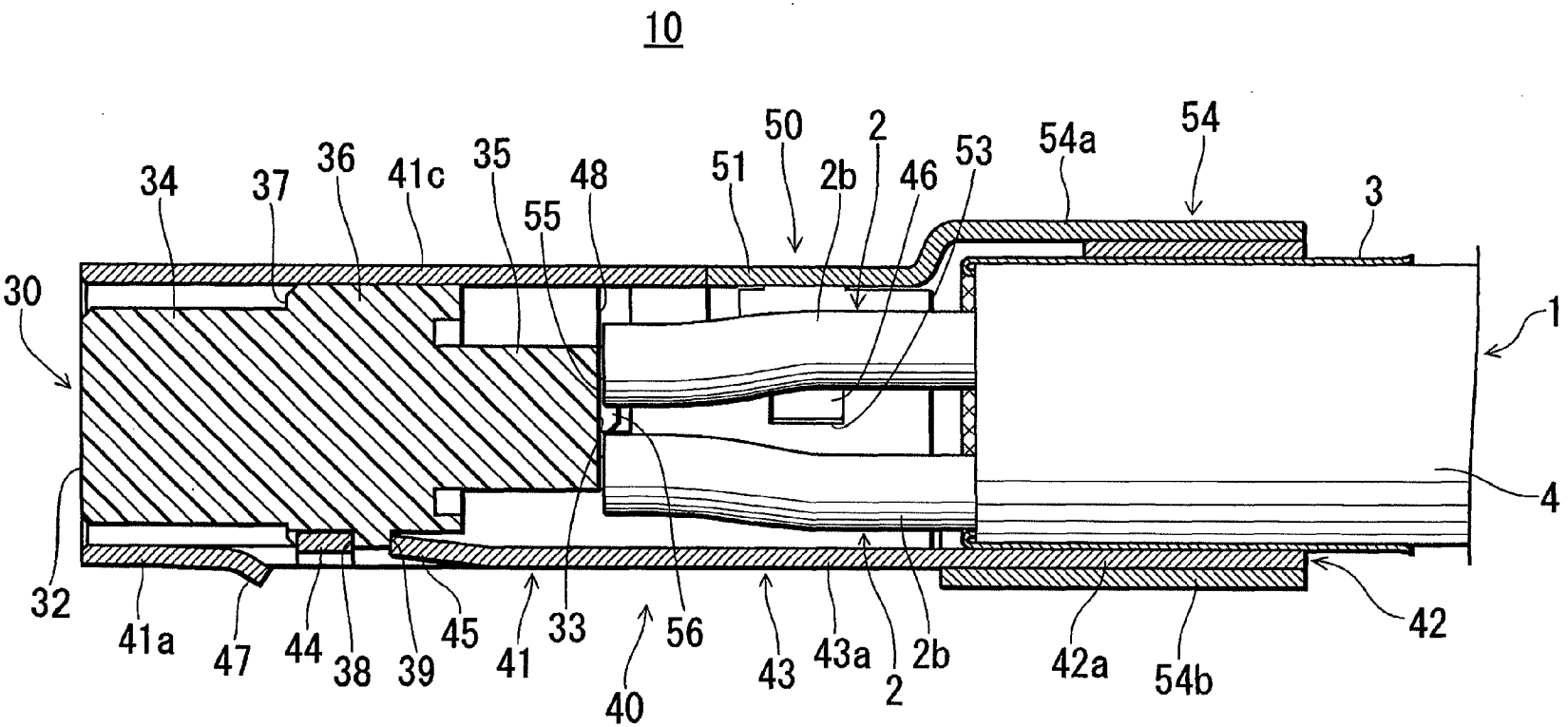
FIG. 2 is a side sectional view of the connector.

In the resin housing 30, as shown in FIG. 2, a forwardly directed step surface 38 and rearwardly directed step surface 39 which are used for fixation to the shield shell 40 are formed in the lower surface of the fixing portion 36 which constitutes a part of the outer wall of the resin housing 30.

The shield shell 40 is formed by performing sheet-metal working on a conductive metal plate material, and, as shown in FIGS. 1 to 3 and 6, has: in the front end, a tubular shielding portion 41 which surrounds, accommodates, and fixes the resin housing 30; in the rear end, a barrel portion 42 which crimps and fixes the sheath 4 of the cable 1; and, between the shielding portion 41 and the barrel portion 42, an opening portion 43 which is upwardly opened. The shielding portion 41 is formed into a straight tubular shape having a total length which is longer than the total length of the resin housing 30, by a rectangular bottom plate 41*a*, a pair of rectangular side plates 41*b*, 41*b* which rise from the side edges of the bottom plate 41*a*, respectively, and a top plate 41*c* which is opposed to the bottom plate 41*a*. The opening portion 43 is formed immediately behind and continuously with the shielding portion 41, and into an upwardly opened U-like shape as viewed from the front side or the rear side, by a bottom plate 43*a* which is a rearward extension of the bottom plate 41*a* of the shielding portion 41, and a pair of side plates 43*b*, 43*b* which are rearward extensions of the side plates 41*b*, 41*b* of the shielding portion 41, respectively. The opening portion 43 functions as an inserting portion which, when the resin housing 30 is to be inserted into the shielding portion 41, is used for inserting the resin housing from the rear side of the shielding portion 41. The barrel portion 42 is formed an upwardly opened U-like shape as viewed from the front side or the rear side, by a connecting piece 42*a* which is rearwardly extended from the bottom plate 43*a* of the opening portion 43, and a pair of crimping pieces 42*b*, 42*b* which rise from the side edges of a rear part of the connecting piece 42*a*, respectively.

In the shield shell 40, as shown in FIG. 2, a stopper 44 which is a non-elastic cut and raised plate portion for fixing the resin housing 30 to a normal position in the shielding portion 41, and an elastic metal lance 45 are formed in the bottom plate 41*a* of the shielding portion 41 by cutting and raising work.

Figure 3:
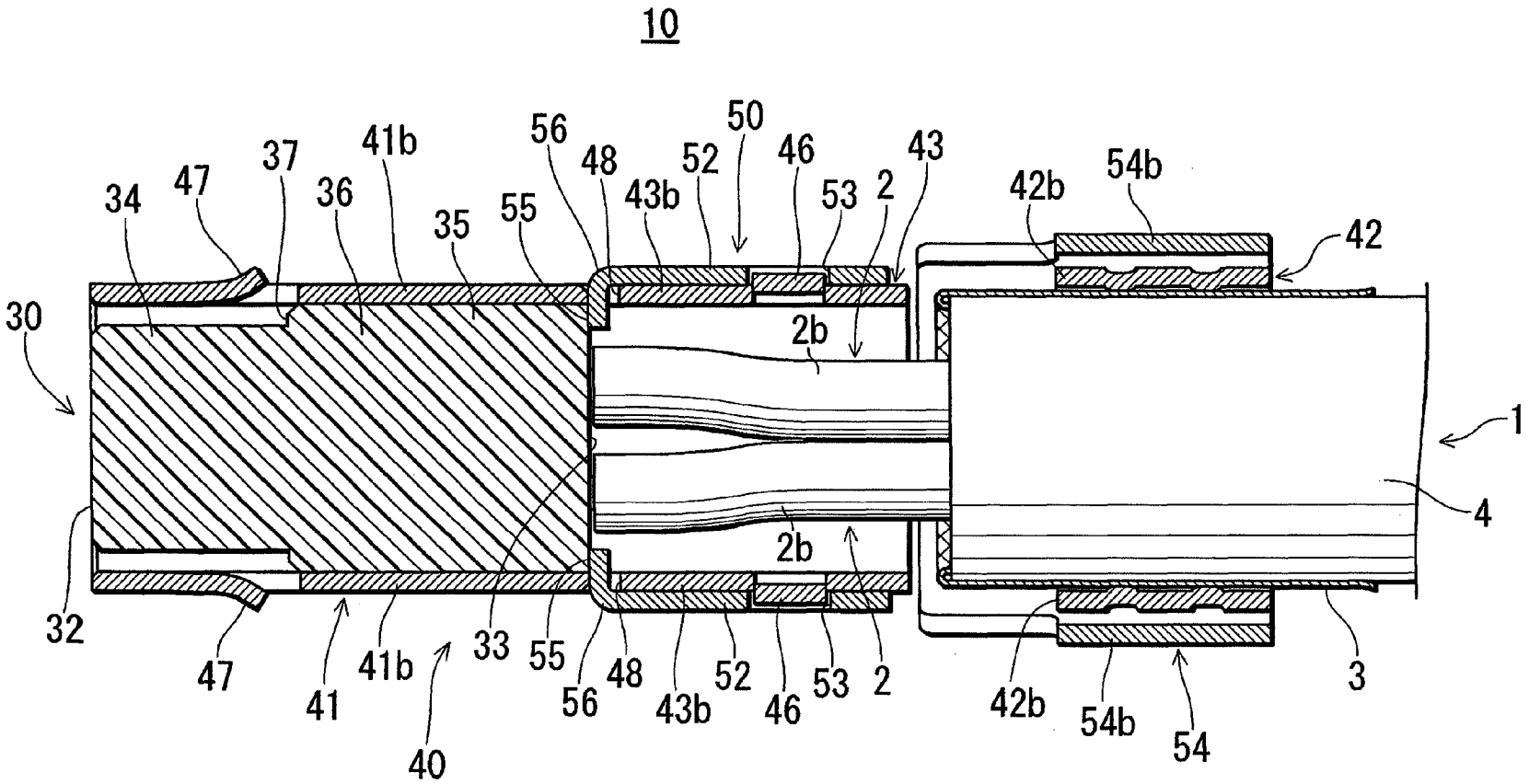
FIG. 3 is a plan sectional view of the connector.

The shield shell 40 is used for fixing the resin housing 30 at the normal position in the shielding portion 41 as shown in FIGS. 1 to 3 by: inserting the resin housing 30 from which the cable 1 is rearwardly drawn out as shown in FIG. 5, into the shielding portion 41 through the opening portion 43; when the resin housing 30 is completely inserted, as shown in FIG. 2, butting the rear one of the front and rear end surfaces of the stopper 44 against the step surface of the resin housing 30 which is directed in the insertion direction, i.e., the forwardly directed step surface 38; and engaging the front end surface of the metal lance 45 which is directed obliquely upwardly, with the step surface of the resin housing 30 which is directed in the pull-out direction, i.e., the rearwardly directed step surface 39. In the resin housing 30, at this time, the front end surface 32 of the resin housing 30 is located in the front end opening surface of the shielding portion 41, the rear end surface 33 of the resin housing 30 is located in front of the rear end opening of the shielding portion 41, and the periphery of the resin housing 30 is surrounded by the shielding portion 41.

The shield shell 40 is connected to the cable 1 in a state where, as shown in FIGS. 1 to 3, the resin housing 30 is fixed at the normal position in the shielding portion 41, and then electrically connected to the shield 3 of the cable 1 as shown in FIGS. 1 to 3. Namely, the pair of crimping pieces 42*b*, 42*b* of the barrel portion 42 are crimped on the sheath 4 in which the shield 3 is folded back to the outside in the end of the cable 1, with a pressure at which the internal core wires 2 are not collapsed and the electric characteristics and the high-frequency characteristics are not impaired.

In the shield shell 40, as shown in FIGS. 1 to 3 and 6, metal lances 46 which are elastic cut and raised plate portions for fixing the shield cover 50 to the opening portion 43 are formed in the side plates 43*b*, 43*b* of the opening portion 43 by cutting and raising work, respectively.

Figure 6:
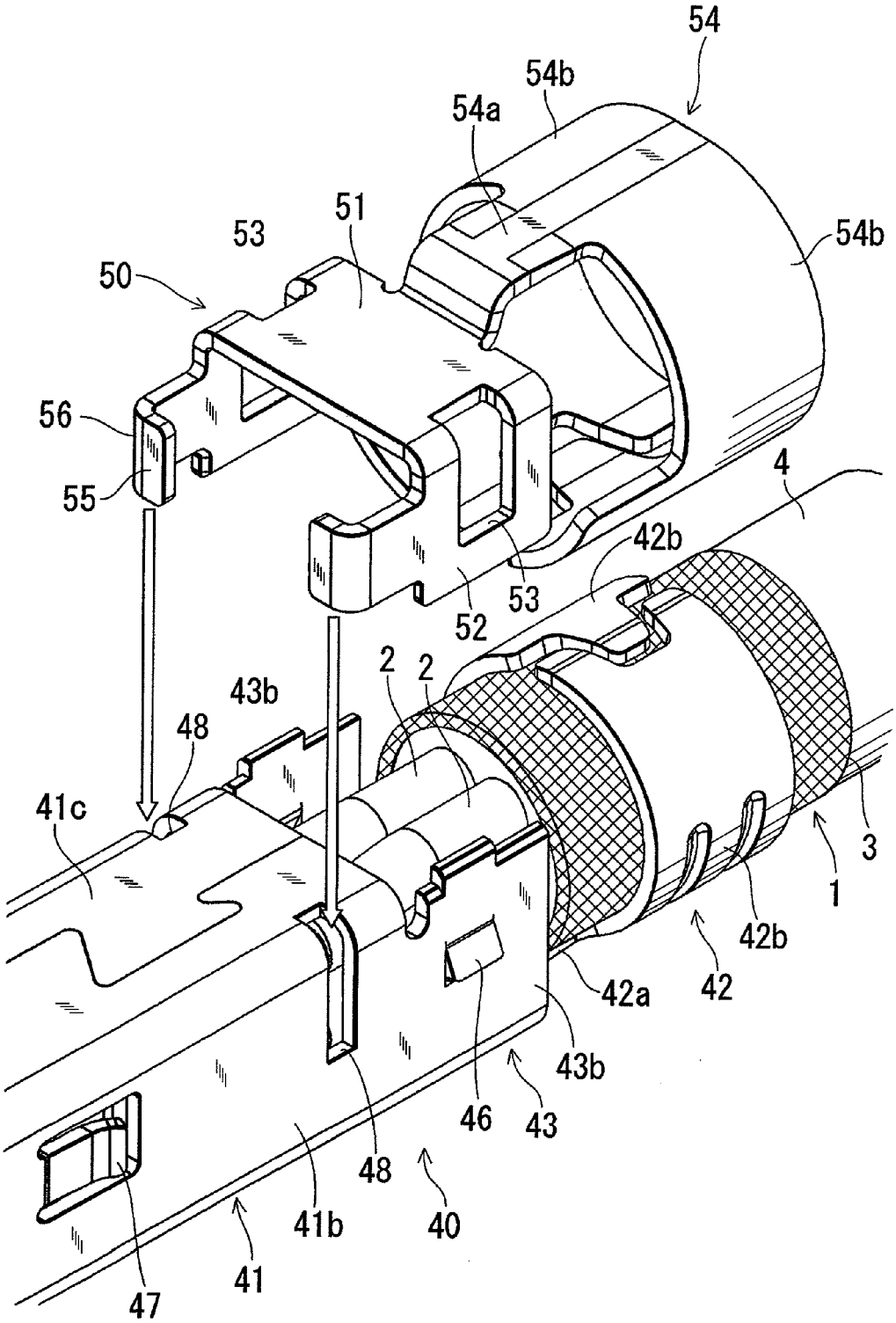
FIG. 6 is a perspective view showing a state where a metal shield cover of the connector is attached to a metal shield shell.

In the shield shell 40, as shown in FIGS. 1, 3, and 6, moreover, metal lances 47 which are elastic cut and raised plate portions for fixing the resin outer housing are formed in the side plates 41*b*, 41*b* of the shielding portion 41 by cutting and raising work, respectively.

In the shield shell 40, as shown in FIGS. 1 to 3 and 6, furthermore, a pair of slits 48, 48 for, when a pair of stoppers which will be described later, and which are disposed in the shield cover 50 are located in acting positions with respect to the resin housing 30, and the shield cover 50 is attached from the upper side to the opening portion 43 of the shield shell 40, causing the pair of stoppers which will be described later, and which are disposed in the shield cover 50, to function as a guide to the normal attachment position of the shield cover 50 are formed in the both side parts of the shielding portion 41, respectively. Each of the pair of slits 48, 48 is continuously formed in the range from one side end part of the top plate 41*c* of the shielding portion 41 to the side plate 41*b* on the side so as to extend along the rear end surface 33 of the resin housing 30 which is fixed at the normal position in the shielding portion 41.

The shield cover 50 is attached from the upper side to the opening portion 43 of the shield shell 40, formed separately from the shield shell 40 by performing sheet-metal working on a conductive metal plate material, and, as shown in FIGS. 1 to 3 and 6, has: a cover piece portion 51 which, when attached from the upper side to the opening portion 43 of the shield shell 40, covers the upper opening surface of the opening portion 43; and a pair of attaching piece portions 52, 52 which are downwardly extended from the both side parts of the cover piece portion 51, to overlap with the outer surfaces of the side plates 43*b*, 43*b* of the opening portion 43, respectively. Engaging holes 53 for fixation to the opening portion 43 of the shield shell 40 are formed in the pair of attaching piece portions 52, 52, respectively. The shield cover 50 further has a barrel portion 54 which crimps and fixes the sheath 4 of the cable 1. The barrel portion 54 is formed into a downwardly opened U-like shape as viewed from the front side or the rear side, by a connecting piece 54*a* which is rearwardly extended from the cover piece portion 51, and a pair of crimping pieces 54*b*, 54*b* which are downwardly extended from the side edges of a rear part of the connecting piece 54*a*, respectively.

The shield cover 50 is configured in the following manner. When, as shown in FIG. 6, the shield cover body configured by the cover piece portion 51 and pair of attaching piece portions 52, 52 of the shield cover 50 is attached from the upper side to the opening portion 43 of the shield shell 40 while the barrel portion 54 of the shield cover 50 is attached from the upper side to the barrel portion 42 of the shield shell 40 in the state where the sheath 4 of the cable 1 is crimped and fixed, the shield cover body is attached from the upper side to the opening portion 43 of the shield shell 40 in the state where the upper opening of the opening portion 43 of the shield shell 40 is covered with the cover piece portion 51 of the shield cover body while, as shown in FIGS. 1 to 3, the pair of attaching piece portions 52, 52 of the shield cover body overlap the outer surfaces of the side plates 43*b*, 43*b* of the opening portion 43 of the shield shell 40. In this case, the pair of engaging holes 53, 53 formed in the pair of attaching piece portions 52, 52 of the shield cover body are engaged with the metal lances 46, 46 formed in the side plates 43*b*, 43*b* of the opening portion 43 of the shield shell 40, whereby the shield cover body is fixed to the opening portion 43 of the shield shell 40, and the opening portion 43 of the shield shell 40 is formed into a straight tubular shape which is continuous to the shielding portion 41, by the shield cover body. At this time, the opening portion 43 of the shield shell 40 which is formed into a straight tubular shape continuous to the shielding portion 41 by the shield cover body is exposed from the sheath 4 of the cable 1 which is rearwardly drawn out from the resin housing 30 accommodated in the shielding portion 41 of the shield shell 40, and accommodates the core wires 2 which are not covered by the shield 3, while surrounding the periphery of the core wires 2.

The shield cover 50 fixes the shield cover body to the opening portion 43 of the shield shell 40, and then is connected to the cable 1 in the state where the cover is electrically connected to the shield 3 of the cable 1, as shown in FIGS. 1 to 3. Namely, the pair of crimping pieces 54*b*, 54*b* of the barrel portion 54 of the shield cover 50 are crimped on the sheath 4 in which the shield 3 is folded back to the outside in the range from the outsides of the pair of crimped crimping pieces 42*b*, 42*b* of the barrel portion 42 of the shield shell 40 to the end of the cable 1, with a pressure at which the internal core wires 2 are not collapsed and the electric characteristics and the high-frequency characteristics are not impaired.

In the shield cover 50, as shown in FIGS. 1 to 3 and 6, stoppers 56 which limit the rearward movement of the resin housing 30 by causing the plate surfaces 55 to be butted against the rear end surface 33 of the resin housing 30 that is fixed at the normal position in the shielding portion 41 of the shield shell 40 are disposed.

In the shield cover 50, as shown in FIGS. 1 to 3 and 6, moreover, the stoppers 56 are disposed in the pair of attaching piece portions 52, 52, respectively, the pair of stoppers 56, 56 are formed by metal pieces which are forwardly projected from the attaching piece portions 52, and which are bent into an L-like shape so that the tip ends are inwardly directed, respectively, tip end portions of the pair of stoppers 56, 56 which are inwardly directed are fitted from the upper side to the both side parts of the shielding portion 41 of the shield shell 40 when the shield cover 50 is attached from the upper side to the opening portion 43 of the shield shell 40, the pair of slits 48, 48 for causing respectively the plate surfaces 55 of the pair of stoppers 56, 56 to be butted against the rear end surface 33 of the resin housing 30 which is accommodated in the normal position in the shielding portion of the shield shell 40 are disposed, and, when the shield cover 50 is to be attached from the upper side to the opening portion 43 of the shield shell 40, the pair of stoppers 56, 56 function as a guide to the normal attachment position of the shield cover 50.

The connector body configured by the metal terminals 20, resin housing 30, shield shell 40, and shield cover 50 which are described above is inserted from the rear side into the resin outer housing which is formed into a tubular shape by performing molding on an insulative synthetic resin material, and the metal lances 47 which are formed in the shielding portion 41 of the shield shell 40 are engaged with the forwardly directed step surfaces formed on the inner wall of the resin outer housing, respectively, to fix the resin outer housing to the connector body, whereby the connector 10 is completed in a state where the connector body and the end of the cable 1 are surrounded and accommodated by the resin outer housing, and the cable 1 is drawn out to the rear side of the resin outer housing.

The fitting counter connector is configured by: a resin housing in which an inserting portion into which the connector 10 is to be inserted is opened in the front side; four metal terminals (pin contacts) which are held by the resin housing, and which are projected into a rear part of the inserting portion; a tubular metal shell that surrounds the metal terminals which are held by the resin housing, and which are projected into the rear part of the inserting portion; and a metal cover which is coveringly attached to the resin housing. For example, the fitting counter connector is mounted on a circuit board of an electronic apparatus.

In a state where the front end surface 32 of the resin housing 30 is opposed to the front end openings of the inserting portion of the fitting counter connector, the connector 10 is inserted into the inserting portion of the fitting counter connector, whereby the connector is fitted (connected) into the fitting counter connector, and the cable 1 is connected to the circuit board. When the connector 10 is inserted into the inserting portion of the fitting counter connector, namely, the metal shell of the fitting counter connector is fitted into the shielding portion 41 of the shield shell 40 to electrically connect the metal shell of the fitting counter connector with the shield shell 40, and, while the fitting portion 34 of the resin housing 30 is fitted into the metal shell of the fitting counter connector, the metal terminals of the fitting counter connector are inserted into the contacting portions 21 of the metal terminals 20 of the connector 10 to electrically connect the metal terminals of the fitting counter connector with the metal terminals 20 of the connector 10, and the core wires 2 of the cable 1 are electrically connected with the circuit board.

An elastic lock arm for preventing the connector 10 from slipping off, and fixing the connector to the fitting counter connector, by, when the connector 10 is completely inserted into the inserting portion of the fitting counter connector, causing the connector to be engaged with the inner wall of the inserting portion of the fitting counter connector is formed on the outer wall of the resin outer housing of the connector 10. Only when the lock arm is operated, the connector 10 can be extracted from the inserting portion of the fitting counter connector.

Next, the functions and effects of the connector 10 of the embodiment will be described while comparing the connector 10 of the embodiment with a connector of a comparative example. It is assumed that the connector of the comparative example has the same configuration as the connector 10 of the embodiment except that the pair of stoppers 56, 56 and that of slits 48, 48 are not disposed.

In both the connector 10 of the embodiment and the connector of the comparative example, the resin housing 30 is inserted from the rear side of the shielding portion 41 of the shield shell 40, and the metal lance 45 which is disposed in the shielding portion 41 limits the rearward movement of the resin housing 30. In both the connector 10 of the embodiment and the connector of the comparative example, when a strong pulling force is applied to the cable 1, moreover, there is a possibility that the force may be applied in the sequence of the core wires 2 of the cable 1→the metal terminals 20→the resin housing 30.

In the connector of the comparative example in which the stoppers 56 are not disposed, therefore, the metal lance 45 bites into the rearwardly directed step surface 39 of the resin housing 30, a trace of the bite causes the resin housing 30 to rattle in the anteroposterior direction, and the rearwardly directed step surface 39 of the resin housing 30 is sometimes shaved, and there is a possibility that the resin housing 30 may slip off from the shielding portion 41. In the connector 10 of the embodiment, by contrast, the stoppers 56 which limit the rearward movement of the resin housing 30 by causing the plate surfaces 55 to be butted against the rear end surface 33 of the resin housing 30 that is fixed at the normal position in the shielding portion 41 are disposed in the shield cover 50, and therefore even the metal lance 45 can function as a stopper in the cable pulling direction for the resin housing 30 without shaving the rearwardly directed step surface 39 of the resin housing 30, and without biting into the rearwardly directed step surface 39 of the resin housing 30. Therefore, double countermeasures against slipping off of the resin housing 30 in the cable pulling direction can be taken. Moreover, the degree of freedom in design of the shield cover 50 is higher than that of the shield shell 40, and the rigidity required in the stoppers 56 can be easily obtained.

In the connector of the comparative example, moreover, the pair of stoppers 56, 56 and that of slits 48, 48 are not disposed, a guide for, when the shield cover 50 is to be attached from the upper side to the opening portion 43 of the shield shell 40, guiding the shield cover 50 to the normal attachment position therefore does not exist, and there is a possibility that the shield cover 50 may be attached at a position deviated from the normal attachment position. In this case, the attachment operation must be again conducted to attach the shield cover at the normal attachment position where the pair of engaging holes 53, are engaged with the pair of metal lances 46, 46. There is a further possibility that a defective product in which the shield cover 50 is not fixed may be produced. In the connector 10 of the embodiment, by contrast, the stoppers 56 are disposed on the pair of attaching piece portions 52, 52 of the shield cover 50, respectively, the pair of stoppers 56, 56 are formed by the metal pieces which are forwardly projected from the attaching piece portions 52, and which are bent into an L-like shape so that the tip ends are inwardly directed, respectively, the pair of slits 48, 48 into which, when the shield cover 50 is to be attached from the upper side to the opening portion 43 of the shield shell 40, the tip end portions of the pair of stoppers 56, 56 that are inwardly directed are fitted from the upper side, and which cause the plate surfaces 55, 55 of the pair of stoppers 56, 56 to be butted against the rear end surface 33 of the resin housing 30 that is accommodated in the normal position in the shielding portion 41 are disposed in the both side parts of the shielding portion 41, and, when the shield cover 50 is to be attached from the upper side to the opening portion 43 of the shield shell 40, the pair of stoppers 56, 56 function as a guide to the normal attachment position of the shield cover 50. Therefore, the shield cover 50 can be easily attached at the normal attachment position, and assembled more easily than the connector of the comparative example.

When stoppers which limit the rearward movement of the resin housing 30 by causing the plate surfaces to be butted against the rear end surface 33 of the resin housing 30 that is fixed at the normal position in the shielding portion 41 are disposed in the shielding portion 41 of the connector of the comparative example, the stoppers project into the insertion path for the resin housing 30 to interfere with the resin housing when the resin housing 30 is to be inserted from the rear side into the shielding portion 41. After the resin housing 30 is completely inserted, therefore, the stoppers must be bent and raised from the shielding portion 41 to be butted against the rear end surface 33 of the resin housing 30. Consequently, steps of assembling the connector are increased. In the connector 10 of the embodiment, by contrast, the stoppers 56 which limit the rearward movement of the resin housing 30 by causing the plate surfaces 55 to be butted against the rear end surface 33 of the resin housing 30 that is fixed at the normal position in the shielding portion 41 are disposed in the shield cover 50. When the resin housing 30 is to be inserted from the rear side into the shielding portion 41, therefore, the stoppers 56 do not exist in the insertion path for the resin housing 30, and, only when the shield cover 50 is attached from the upper side to the opening portion 43 of the shield shell 40 after the resin housing 30 is completely inserted, the stoppers 56 limit the rearward movement of the resin housing 30 by causing the plate surfaces 55 to be butted against the rear end surface 33 of the resin housing 30 that is fixed at the normal position in the shielding portion 41. Even in a connector in which the resin housing 30 is inserted from the rear side of the shielding portion 41, therefore, a countermeasure against slipping off of the resin housing 30 in the cable pulling direction can be taken without increasing steps of assembling the connector.

Next, a connector of another embodiment of the invention will be described. The connector of the embodiment is largely different from the connector 10 in the following point. When the resin housing is to be inserted into the shielding portion of the shield shell, the resin housing is inserted from the rear side of the shielding portion 41 in the connector 10, and by contrast the resin housing is inserted from the front side of the shielding portion 41 in the connector of the embodiment. In association with this, the connector of the embodiment is different from the connector 10 in the following three points, but has the same configuration in the other points as the connector 10. In the first point, the connecting portions of the metal terminals are firstly connected to the core wires of the cable, and the metal terminals are then inserted from the rear side into the terminal accommodating chambers of the resin housing. In the second point, in place of the stopper 44 and metal lance 45 of the connector 10, a stopper for engaging with the rearwardly directed step surface of the resin housing, and a metal lance for engaging with the forwardly directed step surface of the resin housing are disposed in the shielding portion, and the resin housing is fixed at the normal position in the shielding portion. In the third point, in the connector 10, the stopper 56 of the shield cover 50 and the metal lance 45 of the shielding portion 41 cooperate with each other to limit the rearward movement of the resin housing 30, and, in the connector of the embodiment, the stoppers of the shield cover and the stopper of the shielding portion cooperate with each other to limit the rearward movement of the resin housing.

As apparent from the connector of the embodiment and the connector 10, the stoppers 56 which limit the rearward movement of the resin housing 30 by causing the plate surfaces 55 to be butted against the rear end surface 33 of the resin housing 30 that is fixed at the normal position in the shielding portion 41 are disposed in the shield cover 50, and, in both the connector of the embodiment in which the resin housing 30 is inserted from the front side into the shielding portion, and the connector 10 in which the resin housing 30 is inserted into the rear side of the shielding portion 41, a countermeasure against slipping off of the resin housing in the cable pulling direction can be therefore similarly taken.

Next, a connector of a further embodiment of the invention will be described. The connector of the embodiment is different from the connector 10 in the following point. In the connector 10, the stoppers 56 which limit the rearward movement of the resin housing 30 by causing the plate surfaces 55 to be butted against the rear end surface 33 of the resin housing 30 that is fixed at the normal position in the shielding portion 41 are disposed in the shield cover 50. In the connector of the embodiment, by contrast, stoppers which limit the rearward movement of the resin housing 30 by causing the plate surfaces to be butted against a rearwardly directed step surface that is newly formed on the outer wall of the resin housing 30 that is fixed at the normal position in the shielding portion 41, or the existing rearwardly directed step surface that is formed on the outer wall of the resin housing 30 are disposed in the shield cover 50. The connector has the same configuration in the other points as the connector 10.

DESCRIPTION OF REFERENCE NUMERALS

1 cable
2 core wire

4 sheath
10 connector
20 metal terminal
21 contacting portion
22 connecting portion
30 resin housing
33 rear end surface
40 shield shell
41 shielding portion
42 barrel portion
43 opening portion
48 slit
50 shield cover
51 cover piece portion
52 attaching piece portion
55 plate surface
56 stopper

The invention claimed is:

1. A connector including: metal terminals each having, in a front end, a contacting portion that is to be electrically connected to a fitting counter connector, and, in a rear end, a connecting portion that is to be connected to a core wire of a cable; and a resin housing that holds the metal terminals, the connector having a shielding structure configured by:

a shield shell which is formed by sheet-metal working, and which has in a front end a tubular shielding portion that surrounds, accommodates, and fixes the resin housing, in a rear end, a barrel portion that crimps and fixes a sheath of the cable, and, between the shielding portion and the barrel portion, an opening portion that is upwardly opened; and a shield cover which is formed separately from the shield shell by sheet-metal working, and which is attached from an upper side to the opening portion of the shield shell, wherein a stopper and a plate surface are provided by the shield cover, said plate surface being provided by said stopper and being formed by bending a part of the shield cover so as to be inwardly directed, said plate surface being positioned to abut against a rear end surface of the resin housing or a rearwardly directed step surface that is formed on an outer wall of the resin housing, to limit rearward movement of the resin housing that is fixed at the normal position in the shielding portion.

2. A connector including: metal terminals each having, in a front end, a contacting portion that is to be electrically connected to a fitting counter connector, and, in a rear end, a connecting portion that is to be connected to a core wire of a cable; and a resin housing that holds the metal terminals, the connector having a shielding structure configured by:

a shield shell which is formed by sheet-metal working, and which has in a front end a tubular shielding portion that surrounds, accommodates, and fixes the resin housing, in a rear end, a barrel portion that crimps and fixes a sheath of the cable, and, between the shielding portion and the barrel portion, an opening portion that is upwardly opened; and a shield cover which is formed separately from the shield shell by sheet-metal working, and which is attached from an upper side to the opening portion of the shield shell, wherein stoppers are disposed in the shield cover, and the stoppers limit rearward movement of the resin housing by causing a plate surface to be butted against a rearwardly directed step surface which is formed on a rear end surface or outer wall of the resin housing that is fixed at the normal position in the shielding portion, wherein the shield cover has: a cover piece portion which, when the shield cover is attached from the upper side to the opening portion of the shield shell, covers an upper opening surface of the opening portion; and a pair of attaching piece portions which are downwardly extended from both sides of the cover piece portion, to overlap with outer side parts of side surfaces of the opening portion, respectively, the stoppers are disposed respectively in the pair of attaching piece portions, each of the pair of stoppers is configured by a metal piece which is forwardly projected from the corresponding attaching piece portion, and which is bent into an L-like shape to direct a tip end to an inner side, a pair of slits are disposed in both side parts of the shielding portion, tip end portions of the pair of stoppers which are inwardly directed being fitted from the upper side into the slits when the shield cover is attached from the upper side to the opening portion of the shield shell, respectively, thereby causing plate surfaces of the pair of stoppers to be butted against the rearwardly directed step surface which is formed on the rear end surface or outer wall of the resin housing that is accommodated at the normal position in the shielding portion, and, when the shield cover is to be attached from the upper side to the opening portion of the shield shell, the pair of stoppers function as a guide to the normal attachment position of the shield cover.

* * * * *